US006269566B1

(12) United States Patent
Lo

(10) Patent No.: US 6,269,566 B1
(45) Date of Patent: Aug. 7, 2001

(54) GLASS WATER BALL WITH LIGHT EMITTING DEVICE

(75) Inventor: Szu Wei Lo, Nan-Tou Hsien (TW)

(73) Assignee: Single-Tree Art Industry Co., Ltd., Taichung (TW)

( * ) Notice: Subject to any disclaimer, the term of this patent is extended or adjusted under 35 U.S.C. 154(b) by 0 days.

(21) Appl. No.: 09/468,590

(22) Filed: Dec. 21, 1999

(51) Int. Cl.[7] ..... G09F 19/00

(52) U.S. Cl. ..... 40/406; 40/409; 40/410; 446/267

(58) Field of Search ..... 40/406, 409, 410; 446/267

(56) References Cited

U.S. PATENT DOCUMENTS

| | | | | |
|---|---|---|---|---|
| 1,856,098 | * | 5/1932 | Green | 40/406 |
| 3,593,444 | * | 7/1971 | Akrongold | 40/407 |
| 4,771,902 | * | 9/1988 | Teng | 215/376 |
| 5,092,065 | * | 3/1992 | Teng | 40/410 |
| 5,426,877 | * | 6/1995 | Lin | 40/406 |
| 5,548,912 | * | 8/1996 | Liu | 40/430 |
| 5,666,750 | * | 9/1997 | Segan et al. | 40/410 |
| 5,678,918 | * | 10/1997 | Lin | 362/96 |
| 5,711,099 | * | 1/1998 | Nesbit et al. | 40/406 |
| 5,775,014 | * | 7/1998 | Lin | 40/406 |

* cited by examiner

*Primary Examiner*—Anthony Knight
*Assistant Examiner*—Andrea Chop
(74) *Attorney, Agent, or Firm*—Rosenberg, Klein & Lee

(57) ABSTRACT

Glass water ball with light emitting device includes a base seat, a spherical casing, a decoration and a light emitting device. The light emitting device includes a cap member, a fixing unit and a light emitting circuit system. The light of the light emitting element can pass through the cap member to diverge outward gently. The light also can be downward projected to the decoration and then pass through the water liquid and the spherical casing. Finally, the light is reflected and gently diverged in every direction. Therefore, even at night or in a dark place, the glass water ball can achieve an excellent visual beautiful effect. In addition, an illumination adjusting element is disposed for adjusting the illumination. Therefore, glass water ball can provide different illumination and serve as a night lamp.

1 Claim, 5 Drawing Sheets

GLASS WATER BALL WITH LIGHT EMITTING DEVICE

BACKGROUND OF THE INVENTION

The present invention relates to a glass water ball with light emitting device, and more particularly to a glass water ball which is able to provide excellent visual beautiful feeling and can serve as a night lamp.

FIG. 1 shows a conventional glass water ball composed of a base seat 10, a spherical casing 20 and a decoration 30. The spherical casing 20 is transparent and hollow for containing therein a liquid 50 which is generally water. Some of the decorations 50 are rotatable. However, as a whole, such glass water ball lacks visual beauty and fails to provide any decorating function at night or in a dark place.

SUMMARY OF THE INVENTION

It is therefore a primary object of the present invention to provide a glass water ball with adjustable light emitting device which is able to project light outward and inward so that no matter in day or at night, the glass water ball can achieve an excellent visual beautiful feeling.

It is a further object of the present invention to provide the above glass water ball in which an illumination adjusting element is disposed for adjusting the illumination. In cooperation with the internal water liquid and decoration, the glass water ball can provide different illumination effects.

It is still a further object of the present invention to provide the above glass water ball which can serve as a night lamp.

According to the above objects, the glass water ball with light emitting device of the present invention includes a base seat; a spherical casing which is transparent or semitransparent and hollow for containing therein a liquid, the bottom of the spherical casing being fixed on the base seat; a decoration installed in the spherical casing; and a light emitting device installed on the dome of the spherical casing. The light emitting device includes a cap member, a fixing unit and a light emitting circuit system. The cap member is fixed on the fixing unit. The light emitting circuit system at least includes a light emitting element, a power supply element, an illumination adjusting element and multiple electric wires connecting the above elements to form a close circuit. The light emitting element is fixed in the fixing unit.

The present invention can be best understood through the following description and accompanying drawings wherein:

DETAILED DESCRIPTION OF THE PREFERRED EMBODIMENTS

Figure 1:
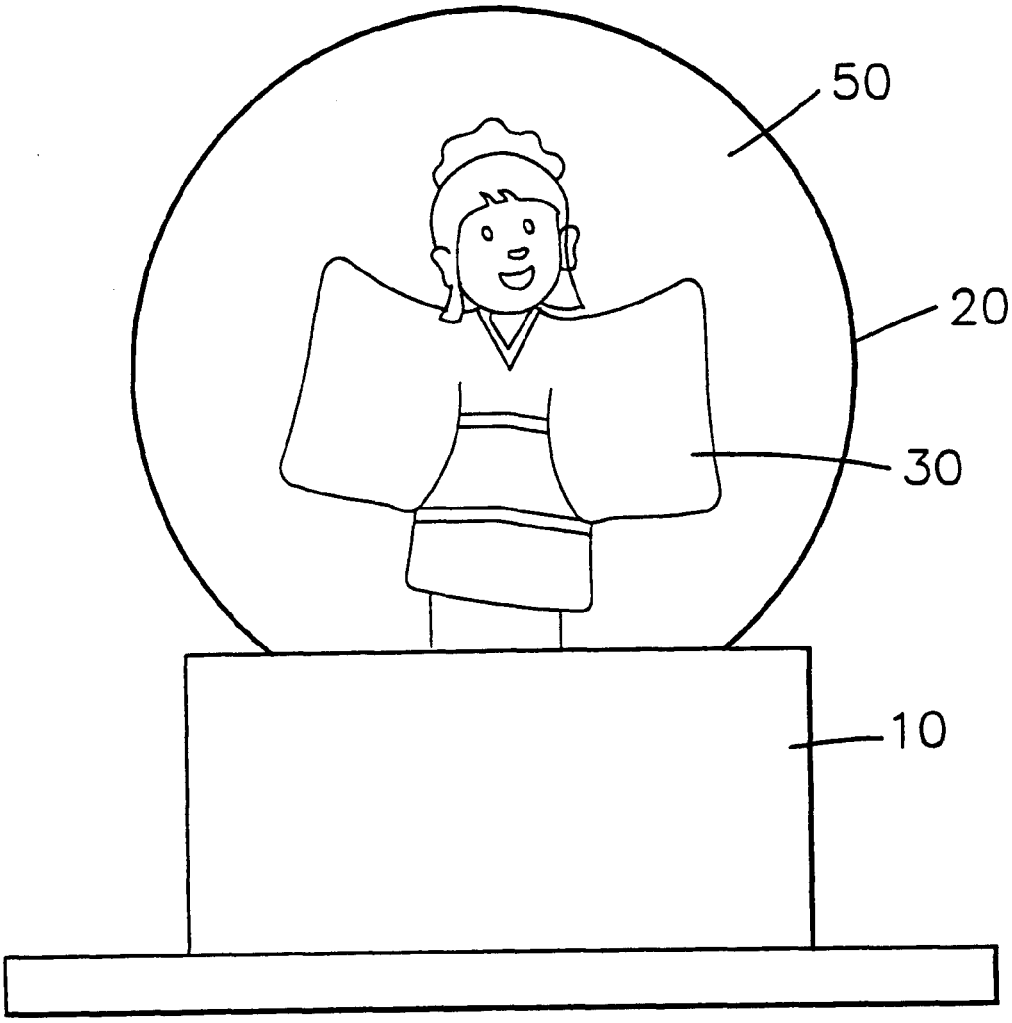
FIG. 1 PRIOR ART
FIG. 1 shows a conventional glass water ball.
Figure 2:
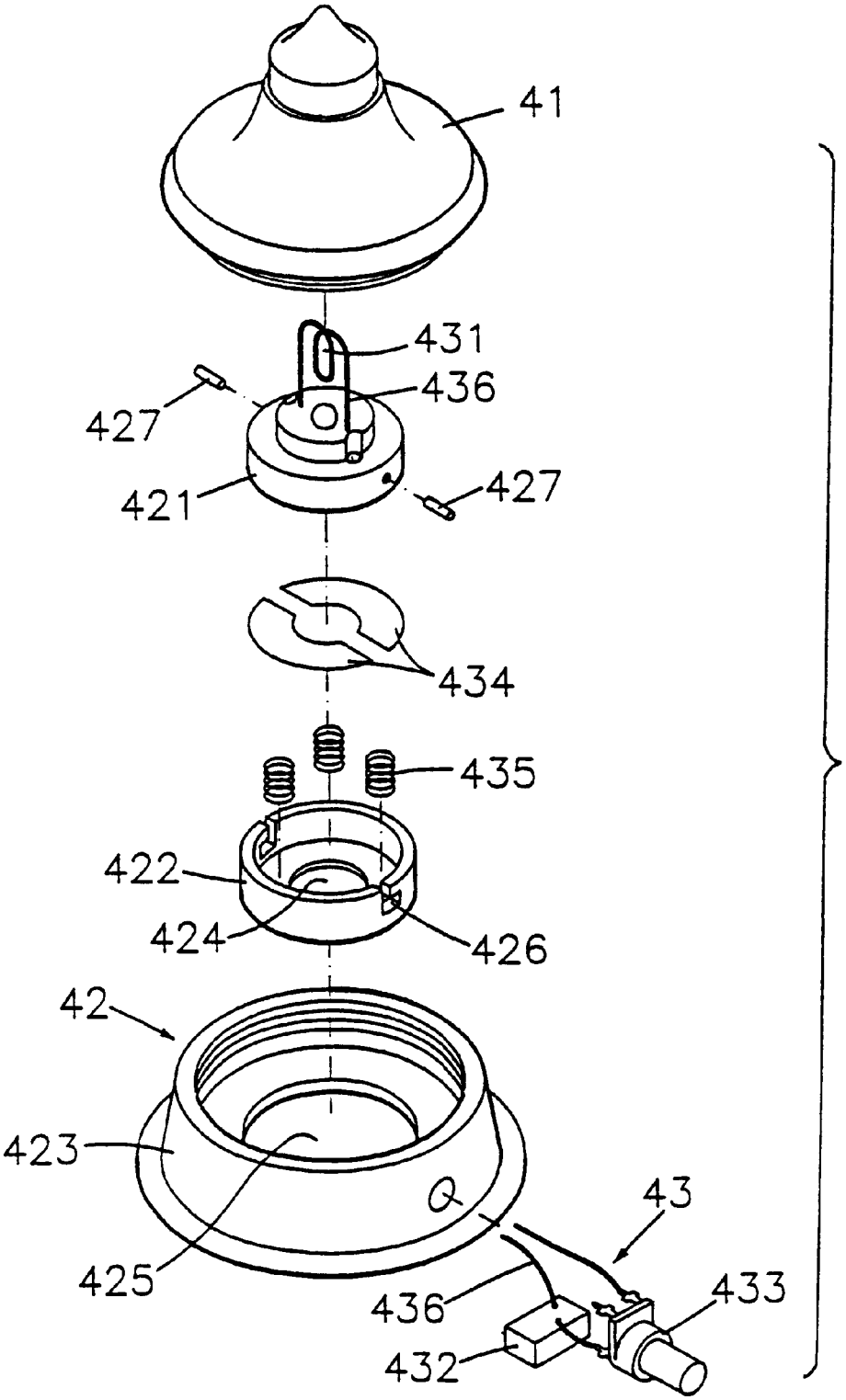
FIG. 2 is a perspective exploded view of the glass water ball of the present invention.
Figure 3:
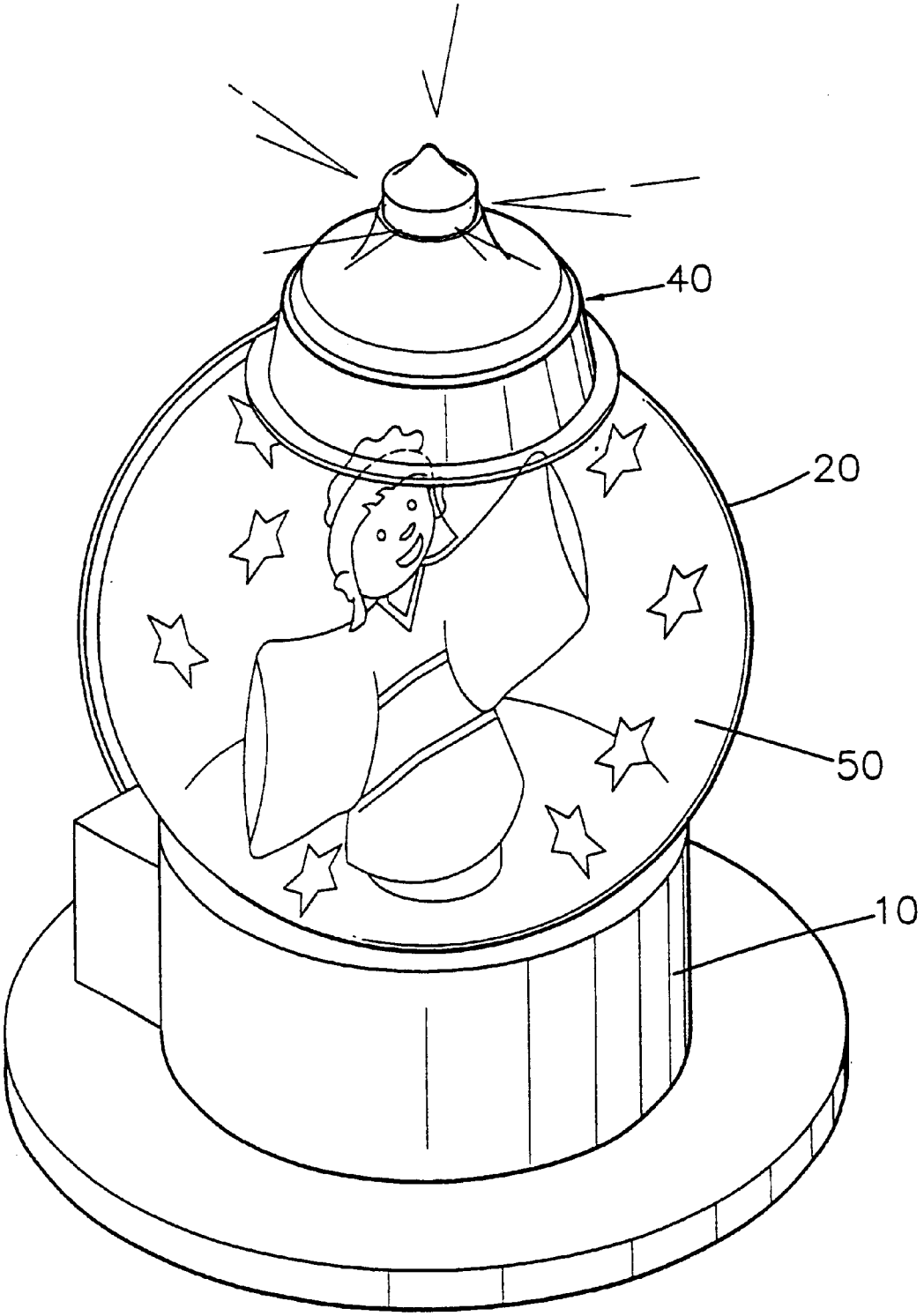
FIG. 3 is a perspective assembled view of the glass water ball of the present invention.
Figure 4:
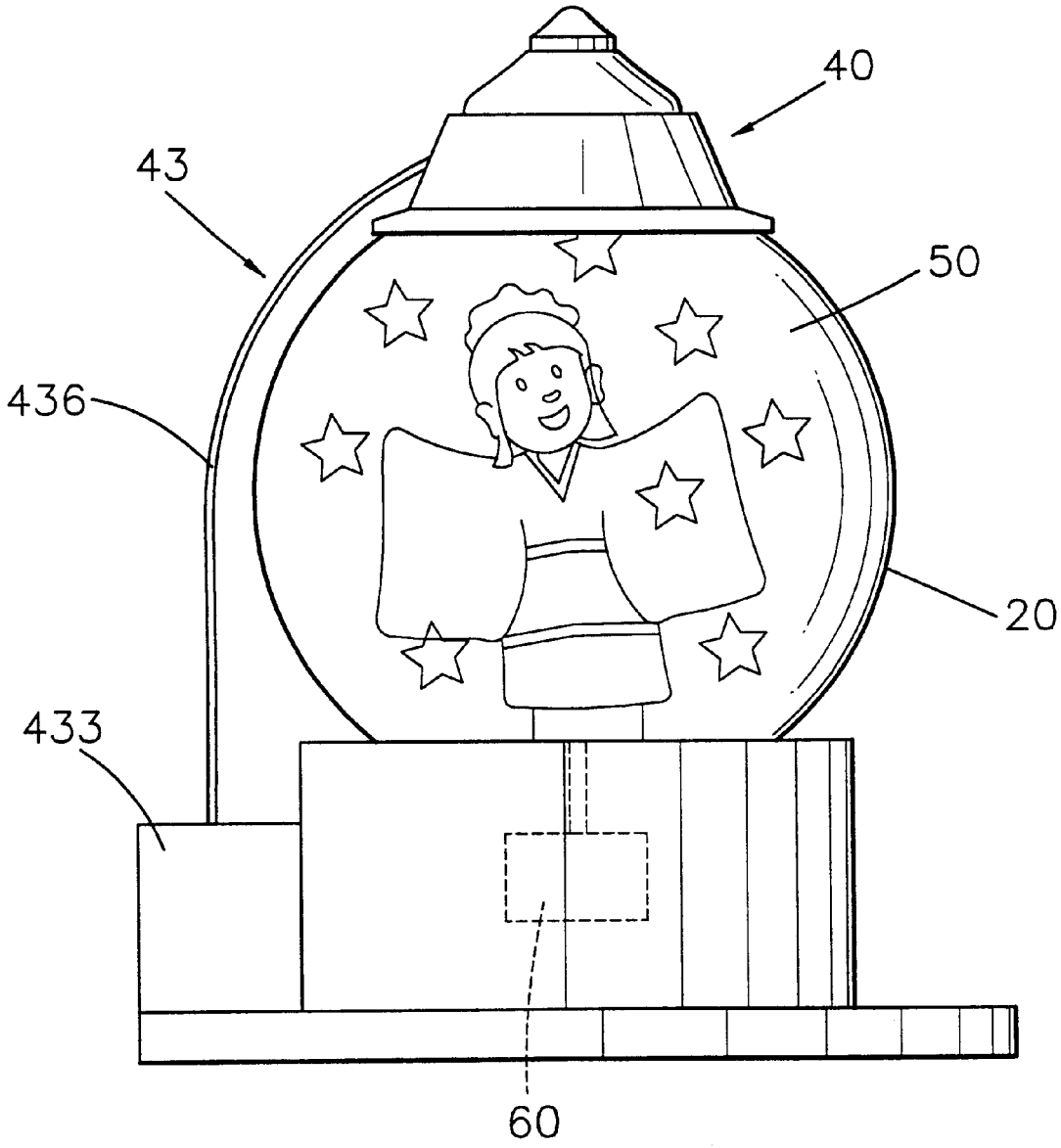
FIG. 4 is a front view of the present invention.
Figure 5:
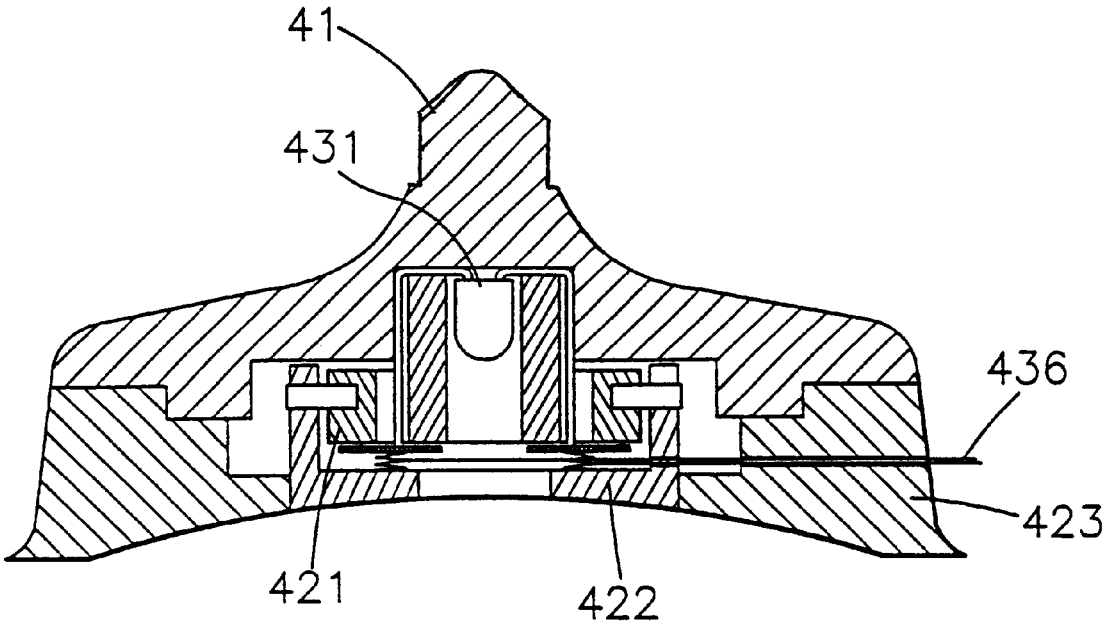
FIG. 5 is a partially sectional view of the light emitting device of the present invention.

Please refer to FIGS. 2 to 5. The glass water ball with light emitting device of the present invention includes a base seat 10, a spherical casino 20, a decoration 30 and a light emitting device 40.

The spherical casing 20 is transparent or semitransparent and hollow for containing therein a liquid 50 which is generally water. The bottom of the spherical casing 20 is fixed on the base seat 10.

The decoration 30 is installed in the spherical casing 20. The decoration 30 can be still or rotatable. The pattern of the decoration 30 can be human, cartoon character, animal, plant, etc.

The light emitting device 40 is installed on the dome of the spherical casing 20, including a cap member 41, a fixing unit 42 and a light emitting circuit system 43.

More specifically, the cap member 41 is fixed on the fixing unit 42. The light emitting circuit system 43 at least includes a light emitting element 431, a power supply element 432 (such as a three-volt DC power ), an illumination adjusting element 433, a pair of spaced conductive plates 434, three conductive springs 435 arranged at about 120 degree intervals and multiple electric wires 436 connecting the above elements to form a close circuit. The light emitting element 431 is fixed in the fixing unit 42.

The fixing unit 42 includes:

(a) a top seat 421 for fixing the light emitting element 431, the top seat 421 having a certain transparency (or having light holes) and including two engaging pins 427;

(b) an inner seat 422 having a first hole 424 and formed with two engaging notches 426 in which the engaging pins 427 of the top seat 421 are engaged; and (c) an outer seat 423 having a second hole 425 for receiving and fixing the inner seat 422 and for fixing the cap member 41.

The light of the light emitting element 431 can pass through the cap member 41 to diverge outwardly and gently. The light further passes through the first and second holes 424, 425 to be first downward projected to the decoration 30 and then the light passes through the water liquid 50 and the spherical casing 20. Finally, the light is reflected and gently diverged in every direction. Therefore, even at night or in a dark place, the present invention can achieve an excellent visual beautiful effect.

In the light emitting circuit system 43 of the above embodiment, the light emitting element 431 is connected with two conductive wires 436 which downward pass through the top seat 421 to respectively connect with the pair of spaced conductive plates 434 (such as copper plates). Then the conductive wires are further respectively connected with at least one conductive spring 435. Finally, the conductive wires are connected to the power supply element 432. The illumination adjusting element 433 can be serially connected with any position of this circuit to control the illumination. Therefore, the present invention also serves as a night lamp.

Of course, if the decoration is rotatable, a driving device 60 (such as a manually operated winding spring or an electric motor) is additionally disposed in the base seat 10. Accordingly, the light downward projected from the light emitting device 40 can cooperate with the rotary decoration 30 and flowing water liquid to create various visual beautiful feeling. In addition, a sound emitting device (not shown) can be further used in cooperation with the light emitting device to achieve even better effect.

Moreover, because the top seat 421 has two engaging pins 427 which can be rotated out or into the engaging notches 426 easily. So, if the user needs to replace a new light emitting element 431 or wants to change a light emitting element 431 with different light color, it can be easily done.

The above embodiments are only used to illustrate the present invention, not intended to limit the scope thereof. Many modifications of the above embodiments can be made without departing from the spirit of the present invention.

What is claimed is:

1. A light emitting decorative apparatus comprising:

(a) a base seat;

(b) a domed casing coupled to said base seat defining an inner compartment for containing a liquid, said casing having a substantially spherical light transmissive portion;

(c) a decorative member disposed within said inner compartment of said casing; and, (d) a light emitting device disposed on said casing, said light emitting device including:

(1) a fixing unit, said fixing unit including a top seat, an outer seat, and an inner seat disposed therebetween; said top seat being at least partially light transmissive, said inner seat having a first hole formed therethrough, said outer seat having formed therethrough a second hole for receiving said inner seat, said first and second holes being substantially aligned;

(2) a cap member coupled to said fixing unit; and, (3) a light emitting circuit system coupled to said top seat of said fixing unit, said light emitting circuit system including:

(i) a power supply element;

(ii) an illumination adjusting element;

(iii) at least one light emitting element, said light emitting element being disposed in said fixing unit, said light emitting element being operable to generate a light for emission through said cap member and through said first and second holes of said fixing unit for illumination of said decorative member in said casing inner compartment; and, (iv) a plurality of conductive elements for electrically interconnecting said power supply, illumination adjusting, and light emitting elements; said conductive elements including at least a pair of spaced conductive plates and a plurality of conductive springs.

* * * * *